US012331628B2

(12) United States Patent
Ellithorp

(10) Patent No.: US 12,331,628 B2
(45) Date of Patent: Jun. 17, 2025

(54) MULTI-STAGE, LIMITED ENTRY DOWNHOLE GAS SEPARATOR

(71) Applicant: Blackjack Production Tools, LLC, Oklahoma City, OK (US)

(72) Inventor: Brian Ellithorp, Edmond, OK (US)

(73) Assignee: Blackjack Production Tools, LLC, Oklahoma City, OK (US)

( * ) Notice: Subject to any disclaimer, the term of this patent is extended or adjusted under 35 U.S.C. 154(b) by 859 days.

(21) Appl. No.: 17/473,410

(22) Filed: Sep. 13, 2021

(65) Prior Publication Data

US 2021/0404311 A1 Dec. 30, 2021

Related U.S. Application Data

(63) Continuation of application No. 16/815,913, filed on Mar. 11, 2020, now Pat. No. 11,131,180.

(60) Provisional application No. 62/816,516, filed on Mar. 11, 2019.

(51) Int. Cl.

| | |
|---|---|
| ***E21B 43/38*** | (2006.01) |
| ***E21B 17/18*** | (2006.01) |
| ***E21B 43/12*** | (2006.01) |

(52) U.S. Cl.

CPC ..... *E21B 43/38* (2013.01); *E21B 17/18* (2013.01); *E21B 43/122* (2013.01)

(58) Field of Classification Search

CPC ..... E21B 43/38; E21B 17/18; E21B 43/122

See application file for complete search history.

(56) References Cited

U.S. PATENT DOCUMENTS

| | | | |
|---|---|---|---|
| 1,578,720 | A | 3/1926 | Derby |
| 1,665,540 | A | 4/1928 | Green |
| 2,883,940 | A | 4/1959 | Gibson |
| 3,357,492 | A | 12/1967 | Hubby |
| 3,894,583 | A | 7/1975 | Morgan |
| 4,241,788 | A | 12/1980 | Brennan |
| 4,676,308 | A | 6/1987 | Chow et al. |
| 4,981,175 | A | 1/1991 | Powers |
| 5,653,286 | A | 8/1997 | McCoy et al. |
| 6,039,121 | A | 3/2000 | Kisman |
| 6,155,345 | A | 12/2000 | Lee et al. |
| 6,325,143 | B1 | 12/2001 | Scarsdale |
| 6,932,160 | B2 | 8/2005 | Murray et al. |
| 7,021,373 | B2 | 4/2006 | Hardgrave |
| 7,055,595 | B2 | 6/2006 | Mack et al. |
| 7,270,178 | B2 | 9/2007 | Selph |

(Continued)

OTHER PUBLICATIONS

International Searching Authority, "PCT Written Opinion of the International Searching Authority", Dec. 14, 2018, 9 pages, Republic of Korea.

(Continued)

*Primary Examiner* — Christopher P Jones
*Assistant Examiner* — Phillip Y Shao
(74) *Attorney, Agent, or Firm* — Tomlinson McKinstry, P.C.

(57) ABSTRACT

A gas separator for use in a wellbore. The separator has an annular, staged separator system, whereby a liquid-gas mixture is separated into its liquid and gas components. Gas components are allowed to escape up the annulus around the separator, while liquid components are captured on each stage and removed through an inner tube. The inner tube has limited entry ports. These ports may be sized such that ports at the top of the string have a smaller, more limited entry than those toward the bottom.

15 Claims, 7 Drawing Sheets

(56) References Cited

U.S. PATENT DOCUMENTS

| | | | |
|---|---|---|---|
| 7,635,030 | B2 | 12/2009 | Knight et al. |
| 7,736,133 | B2 | 6/2010 | Martinez |
| 8,141,625 | B2 | 3/2012 | Reid |
| 8,397,811 | B2 | 3/2013 | Reid |
| 9,518,458 | B2 | 12/2016 | Ellithorp et al. |
| 9,909,400 | B2 | 3/2018 | Ellithorp et al. |
| 10,385,672 | B2 | 8/2019 | Zahran |
| 10,907,462 | B2 | 2/2021 | Marshall |
| 11,492,888 | B2 | 11/2022 | Marshall |
| 2005/0081718 | A1 | 4/2005 | Carruth |
| 2007/0119588 | A1 | 5/2007 | Gonzalez |
| 2009/0065202 | A1 | 3/2009 | Brown et al. |
| 2010/0031992 | A1 | 2/2010 | Hsu |
| 2013/0032341 | A1 | 2/2013 | Raglin |
| 2013/0068455 | A1 | 3/2013 | Brown et al. |
| 2017/0044888 | A1 | 2/2017 | Bommer |
| 2017/0058654 | A1 | 3/2017 | Ellithorp et al. |
| 2017/0081952 | A1 | 3/2017 | Osborne et al. |
| 2018/0023379 | A1 | 1/2018 | Marshall |
| 2018/0187531 | A1 | 7/2018 | Ellithorp et al. |
| 2018/0280834 | A1 | 10/2018 | Marshall |
| 2019/0055809 | A1 | 2/2019 | Ellithorp |

OTHER PUBLICATIONS

International Searching Authority, "PCT International Search Report", Dec. 14, 2018, 3 pages, Republic of Korea.

International Bureau of WIPO, "PCT International Preliminary Report on Patentability", Feb. 18, 2020, 10 pages, Geneva, Switzerland.

International Search Authority, "PCT International Search Report", 3 pages, Jun. 24, 2020, Korean Intellectual Property Office.

International Search Authority, "Written Opinion of the International Searching Authority", 8 pages, Jun. 24, 2020, Korean Intellectual Property Office.

USPTO Office Communication, "Third-party submission under 37 CFR 1.290", 32 pages, Nov. 18, 2020, USPTO.

MULTI-STAGE, LIMITED ENTRY DOWNHOLE GAS SEPARATOR

BACKGROUND

When pumping from a hydrocarbon producing well containing gas and liquid it is known to be desirable to separate the gas from the liquid in order for the pump to operate effectively. Known gas separators have various deficiencies such that gas interference, resultant gas-locking, and potential resultant damages to downhole pumping equipment, as well as downtime and deferred production is an ongoing problem.

Some examples of gas separators are described in U.S. Pat. No. 6,932,160 by Murray et al, U.S. Pat. No. 7,055,595 by Mack et al, U.S. Pat. No. 4,676,308 by Chow et al, and U.S. Pat. No. 2,883,940 by Gibson et al. Known gas separator devices can typically have limited effectiveness while occupying large amounts of space within the interior diameter of the well casing such that insertion and removal from the well casing may be awkward and difficult, and/or limited access is provided for other downhole tools if desired.

SUMMARY

The present invention is directed to a gas separator assembly for use downhole in a wellbore. The assembly is configured for placement in an outer casing. The assembly comprises an elongate outer tube, an elongate inner tube, and a pump. The elongate outer tube is configured to be received within the outer casing. An outer annular region is defined between the outer tube and the outer casing. The elongate inner tube disposed within the outer tube and defines an inner passage within the inner tube. An inner annular region is defined between the inner tube and the outer tube. The pump is in communication with the inner passage. A plurality of separator stages are defined along a length of the separator assembly, in series, and each separator stage is defined by at least one limited entry port which communicates fluid from the inner annular region into the inner tube.

In another aspect, the present invention is directed to a separator assembly. The assembly comprises an elongate first tube, an elongate second tube, and a plurality of isolator segments. The first tube is in communication with a pump. The second tube is disposed about the first tube along its length to form a first annular region therebetween. The isolator segments are disposed within the first annular region, each segment separating the first annular region into adjacent separator stages. A plurality of intake openings are formed in the outer tube to interconnect the first annular region of each separator stage with a region external to the outer tube. At least one limited access port is formed in the inner tube to interconnect the inner tube with the first annular region of each separator stage.

DETAILED DESCRIPTION

Figure 1:
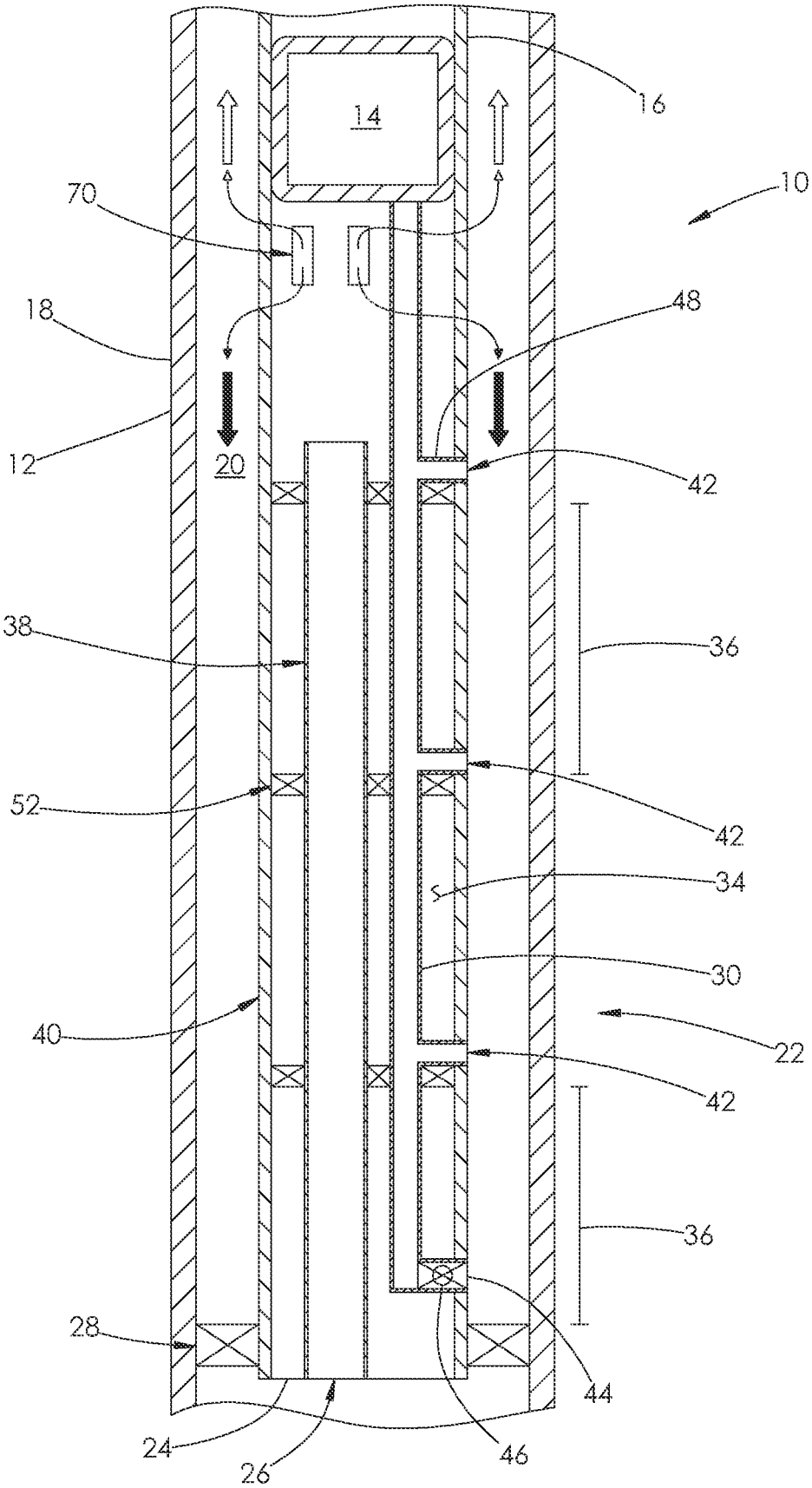
FIG. 1 is a schematic representation of a gas separator assembly having an upper discharge point with annular separation chamber and a series of lower entry points for fluid intake and production.

Referring to the accompanying figures, there is illustrated a gas separator assembly generally indicated by reference numeral 10. The assembly 10 is particularly suited for use in a downhole wellbore for separation of gas and liquids from a multi-phase fluid. The downhole wellbore typically comprises an outer casing 12 extending longitudinally along the wellbore between a wellhead at the surface of the ground and a hydrocarbon formation in the ground. The gas separator assembly 10 is generally used together with a pump 14 for pumping fluids up the wellbore for collection at the surface. The pump 14 may be mounted at the bottom end of a tubing string 16 received longitudinally within the outer casing 12 with the gas separator assembly 10 in turn being supported on the bottom of the tubing string 16 below the pump 14.

Although various embodiments of the gas separator assembly are illustrated in the accompanying figures, the features in common with the first three embodiments will first be described.

In each instance the assembly 10 includes an outer tube 18 which is adapted to be received within the outer casing 12 so as to extend in a longitudinal direction along a length of the outer casing. The outer tube 18 effectively defines an outer annular region 20 between the outer tube and the outer casing 12. The outer tube 18 can be connected in series with the tubing string 16 thereabove at a location below the pump 14. The outer tube 18 typically extends the length of a multistage separator section 22 of the assembly 10 as described in further detail below.

The assembly further includes an intake section 24 connected in series with the outer tube 18 at a location therebelow at the bottom end of the assembly 10. The intake section includes an intake opening 26 at the bottom end thereof which is in communication with the remaining outer casing 12 extending below the assembly 10 which in turn communicates with a surrounding hydrocarbon formation.

An isolation plug 28 is provided for spanning the outer annular region 20 between the intake section 24 in the surrounding outer casing 12 for blocking direct communication of fluids from the portion of the outer casing below the isolation plug to the outer annular region 20 above the isolation plug.

An inner tube 30 is supported within the outer tube 18 at a location above the intake section 24 to define a separate, inner passage therein. The top end of the inner tube 30 is connected to the pump 14 such that fluids within the inner tube 30 are drawn upwardly by the pump for pumping up through the tubing string 16 of the assembly 10. A remaining area surrounding the inner tube 30 to span between the inner tube and the surrounding outer tube 18 typically comprises an inner annular passage 34 as described in further detail below. The inner tube 30 also typically extends a height of the multistage separator section 22.

An overall height of the multistage separator section 22 locating the inner tubes therein is further subdivided into a plurality of separator stages 36 mounted one above the other in series to form a column. A separate portion of fluid is communicated from the outer annular region 20 into the inner passage of the inner tube 30 at each separator stage 36 in which all of the fluid entering at each stage enters the inner tube 30 at a common elevation which is different from the elevation of the other separator stages.

Figure 2:
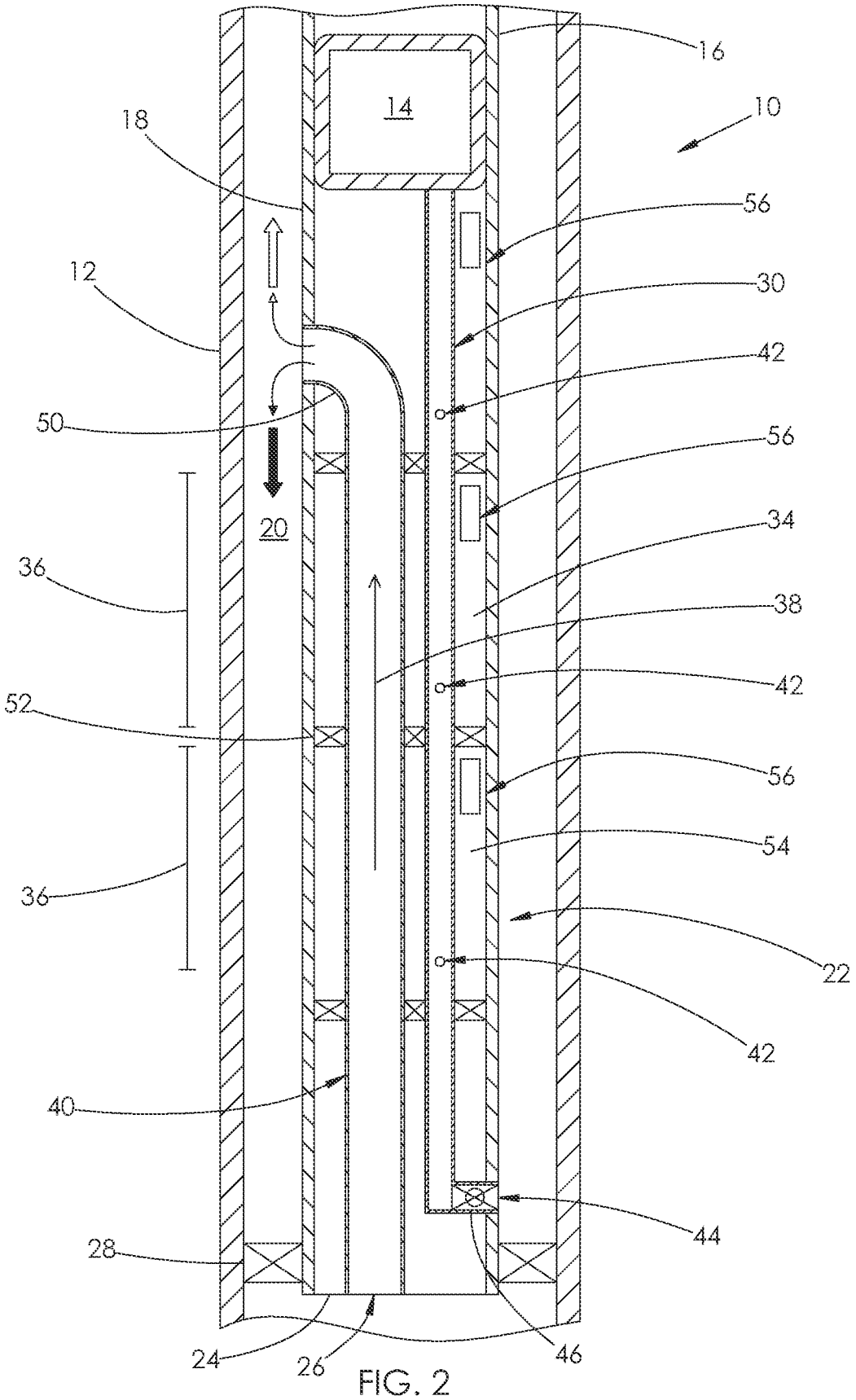
FIG. 2 is schematic representation of a gas separator assembly having an upper discharge point with both annular and a series of internal gas separation chambers for fluid intake and production.
Figure 3:
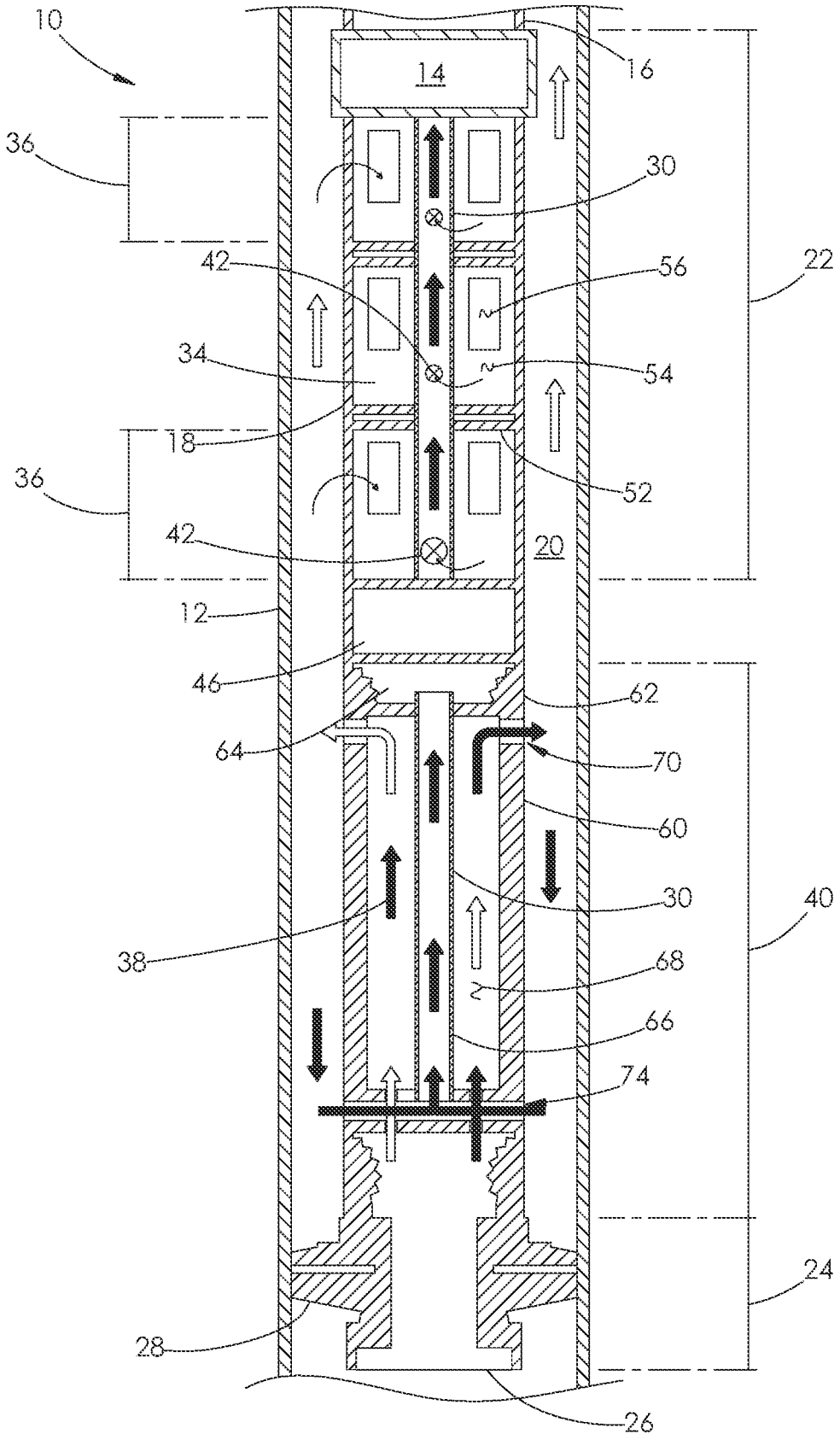
FIG. 3 is a schematic representation of a gas separator assembly having a multi-stage section in series with a diversion or packer type separator.

The assembly 10 of FIGS. 1-3 further includes a diversion apparatus which defines a diversion path 38 therethrough that is isolated from the inner passage of the inner tube 30 and which communicates from a bottom end of the diversion apparatus 30 in open communication with the intake opening of the intake section 24 to a top end in open communication through the outer tube 18 to the outer annular region 20.

The diversion apparatus functions as a diversion separator section 40 in addition to the multistage separator section 22. In the embodiment according to FIGS. 1 and 2, the diversion separator section 40 extends alongside the multistage separator section 22 such that the two sections longitudinally overlap one another; however, in the embodiment of FIG. 3, the diversion separator section 40 is located fully below the multistage separator section 22 such that the sections 40 and 22 are longitudinally in series with one another.

In either embodiment, the multistage separator section 22 locates one or more limited entry ports 42 at each separator stage that collectively define a combined cross-sectional flow area. The limited entry ports 42 each comprise a restricted orifice of fixed dimension in the communication path between the outer annular region and the inner passage of the inner tube 30 to provide restricted communication of fluids from the outer annular region to the inner passage of the inner tube. For clarity, the phrase "limited entry" means that the ports are sized such that the flow rate of liquid material from the inner annular region 34 of each stage 36 into the inner tube 30 is restricted by the size of the port 42. This is to contrast limited entry ports with ports typically seen in conventional separators, in which the inner tube 30 or similar structure has no restriction of fluid.

Typically the cross-sectional flow area of all limited entry ports at any one level or any one separator stage is smaller than the combined cross-sectional flow area of all limited entry ports 42 of any one level or separator stage therebelow. The sizing may be arranged such that despite the pressure differential existing between each separator stage at different elevations relative to one another, a similar volume of fluid is intended to be drawn from each separator stage at each corresponding elevation. In this manner fluids are drawn from the outer annular region into the inner tube at a substantially even distribution across a plurality of different elevations along the limited-entry multiple chamber separator 22.

Alternatively, each port could also be the same size (e.g., 1/16", 1/8", etc.) or there could be several of the same size with one or more of larger size below them (e.g., (3)×1/16" and (2)×1/8" below). Accordingly, the areas of the limited entry ports 42 are not necessarily all to be one size, with increasing size from top to bottom preferred.

In both embodiments, the bottom end of the inner tube 30 includes a bottom entry port 44 that also receives fluid from the outer annular region into the inner passage of the inner tube, but at a location which is below all of the separator stages of the multistage separator section 22, such that the bottom entry port 44 is spaced below all of the limited entry ports 42. The bottom entry port 44 may locate a pressure responsive variable valve 46 therein in which the valve is operable through a range of cross-sectional flow areas from a fully open position of the valve defining a maximum cross-sectional flow area through the bottom entry port to a fully closed position in which flow through the bottom entry port is shut off.

When provided, the variable valve 46 operates in response to pressure differential across the valve between the outer annular region and the bottom of the inner passage of the inner tube. When the pressure differential is below a minimum threshold, the variable valve 46 remains closed such that all fluid drawn into the inner passage of the inner tube is only drawn through the limited entry ports 42 of the multistage separator section. The fluid in the outer annular region has already been drawn through the diverter separator section 40 in this instance. When the pressure differential exceeds the prescribed minimum threshold setting of the valve, the valve begins to open and continues to open by larger amounts as the pressure differential increases until the valve reaches the fully open position when the pressure differential exceeds a maximum threshold. The cross-sectional flow area of the bottom entry port in the fully open position of the variable valve is equal to or greater than the cross-sectional flow area of the limited entry ports of any one separator stage, and more preferably is greater than the cross-sectional flow area of the limited entry ports of all separator stages combined. In this instance, if all of the limited entry ports 42 became plugged, the assembly can maintain overall flow rates therethrough by fully opening the variable valve. When the variable valve is open, flow can be redirected directly from the diversion separator section 40 into the inner passage of the inner tube, thereby bypassing the plugged limited entry ports of the multistage separator section 22.

Alternatively, when there is no variable valve 46 in the bottom entry port 44, the bottom entry port may be partially restricted; however, the flow area of the bottom entry port preferably remains equal to or greater than a combined flow area of all limited entry ports 42.

As described herein, in each instance of the first three embodiments when a variable valve 46 is provided, the assembly is operable in a first mode providing diversion separation from the bottom intake opening to the outer annular region through the diversion separator section 40 followed by an even distribution of fluid from the outer annular region to the inner tube across the plurality of different separator stages 36 at different elevations. As the limited entry ports 42 become plugged, the assembly assumes a second mode of operation in which the variable valve 46 opens proportionally to the amount of reduced flow from the limited entry ports to compensate for the reduced flow through the multistage separator section and maintain overall flow through the assembly 10.

Turning now more particularly to the first and second embodiments of FIGS. 1 and 2, the multistage separator section in this instance longitudinally overlaps the diversion separator section 40. Accordingly, the intake section 24 in this instance is formed directly at the bottom end of the outer tube 18 such that the intake opening comprises the open bottom end of the outer tube, and the diversion flow path through the diverter separator section extends upwardly through the inner annular region of the outer tube, alongside the inner tube 30. The top end of a diversion passage communicates through the outer tube 18 such that the top end of the diversion passage is in open communication with the outer annular region above the separator stages of the multistage separator section 22. Furthermore, the bottom end of the inner tube 30 communicates through the outer tube 18 at the bottom end of the outer tube immediately above the isolation plug 28 at a location below the separator stages 36 such that the bottom end of the inner passage of the inner tube draws fluid from the bottom of the outer annular region as regulated by the variable valve 46 within the bottom entry port 44.

Within the embodiment of FIG. 1 in particular, the orifices defining the limited entry ports 42 are located within the outer tube 18 such that each limited entry port communicates through a respective tubular channel 48 from the limited entry port in the outer tube to the inner passage of the inner tube 30 at the respective elevation of the separator stage 36. The remainder of the inner annular region surrounding the inner tube 30 in this embodiment defines part of the diversion passage communicating from the open bottom end of the outer tube 18 to the discharge outlets at the top end of the outer tube that communicate the fluid from the intake opening to the outer annular region.

Within the embodiment of FIG. 2, a diversion tube 50 is provided within the interior of the outer tube 18 to run alongside the inner tube 30. The diversion tube 50 has a bottom end in open communication with the intake opening at the bottom of the assembly to define a portion of the diversion passage 43 of the diversion separator section which extends upwardly along the length of the outer tube 18 to a top end communicating through the outer tube into the outer annular region. In this embodiment, each of the separator stages 36 comprises a segmented portion of the inner annular region about the inner tube 30 and the diversion tube 50 which is enclosed at longitudinally opposing ends by respective isolation members 52. Each separator stage 36 thus comprises a respective separator chamber 54 which is isolated longitudinally between a pair of the isolation members 52. At each separator stage 36, an intake slot 56 comprising one or more openings communicates through the outer tube 18 so that fluids from the outer annular region may enter the respective separator chamber 54.

The limited entry ports 42 associated with the respective separator stage are in turn located within the inner tube 30 adjacent the bottom end of the chamber 54 of that separator stage so that fluid from the separator chamber communicates through the limited entry ports into the inner passage of the inner tube. The intake slots 56 of each stage are arranged to be less restrictive than the limited entry ports of the same stage such that fluid may readily enter through the intake slots into the separator chambers 54, however, gas can also escape from the separator chambers 54 back into the outer annular region through the intake slots 56. Both the diversion tube 50 and the inner tube 30 communicate through each isolation member 52 to maintain isolation between the interiors of the tubes and the surrounding separator chambers 54 with the exception of the communication of fluid from the separator chambers into the interior passage of the inner tube through the limited entry ports 42 as described herein.

Turning now to the third embodiment shown in FIG. 3, the multistage separator section 22 in this instance is located fully above the diversion separator section 40 such that the sections are longitudinally in series with one another.

The multistage separator section 22 in FIG. 3 is similar to the previous embodiment of FIG. 2 in that the inner annular region between the inner tube 30 and the outer tube 18 locates a plurality of isolation members 52 defining upper and lower boundaries of respective separator stages that each comprise a separator chamber 54. Also as in the previous embodiment, in the embodiment of FIG. 3, intake slots 56 communicate through the outer tube 18 at the top of each chamber 54 and the limited entry ports 42 are located in the inner tube 30 at the bottom of the respective chamber 54.

The diversion separator section 40 in this instance includes its own outer tubular member 60 connected in series with the outer tube 18 thereabove and the intake section 24 therebelow. The intake section in this instance comprises its own tubular member. An upper isolation member 62 is mounted within the outer tubular member to span the interior of the outer tube adjacent the top end thereof. The remaining interior of the outer tubular member 60 above the upper isolation member 62 comprises an upper region 64 in open communication with the bottom entry port 44 at the bottom of the inner tube located thereabove. The variable valve of 46 in this instance regulates flow from the upper region 64 of the diversion separator section 40 to the bottom end of the inner passage of the inner tube 30 thereabove.

An inner tubular member 66 is mounted within the outer tubular member 60 to span substantially the full length of the outer tubular member. The top end of the inner tubular member 66 communicates through the upper isolation member such that an inner passage extending longitudinally inside the inner tubular member 66 is in open communication at the top end thereof with the upper region 64. An intermediate annular region 68 is defined between the inner tubular member and the outer tubular member to extend longitudinally along the length of the diversion separator section 40. Discharge ports 70 are provided in communication through the outer tubular member 60 adjacent the top end thereof immediately below the upper isolation member 62 such that the intermediate annular region 68 is in communication at the top end thereof with the surrounding outer annular region 20 and the outer annular region between the outer tubular member 60 and the surrounding casing. The outer annular region 20 surrounding the outer tubular member 60 is in open communication with the outer annular region surrounding the outer tube 18 thereabove. The bottom end of the intermediate annular region 68 within the outer tubular member 60 is in open communication with the intake opening of the intake section 24 therebelow. A plurality of radial tubes 74 are mounted in communication from the bottom end of the inner tubular member 66 to the outer annular region 20 adjacent the bottom end of the outer tubular member 60 at a location immediately above the isolation plug 28. The bottom end of the inner tubular member 66 is otherwise closed such that any fluid entering the inner tubular member 66 can only enter from the bottom end of the outer annular region 20 through the radial tubes 74 providing an open communication path therebetween.

The diversion flow path 38 in this instance extends from the intake section 24 up through the intermediate annular region 68 alongside the inner tubular member 66 prior to being diverted into the outer annular region 20 through the discharge ports 70 where the fluid can undergo some degree of separation where gasses can rise up through the outer annular region of the assembly and other fluids can fall down through the outer annular region 20 to enter into the inner passage of the inner tubular member via the radial tubes 74.

In the first mode of operation when the variable valve is closed, fluid enters the inner passage of the inner tube 30 of the multistage separator section thereabove only by being drawn through the limited entry ports 42 from the outer annular region, through the separator chambers and into the inner passage of the inner tube 30. In the event of any reduced flow through the limited entry ports 42, the resulting pressure differential causes the variable valve 46 to assume a second mode of operation in which the valve at least partially opens so that some fluid can be drawn from the bottom end of the outer annular region 20 through the inner tubular member 66 of the diversion apparatus.

Figure 4:
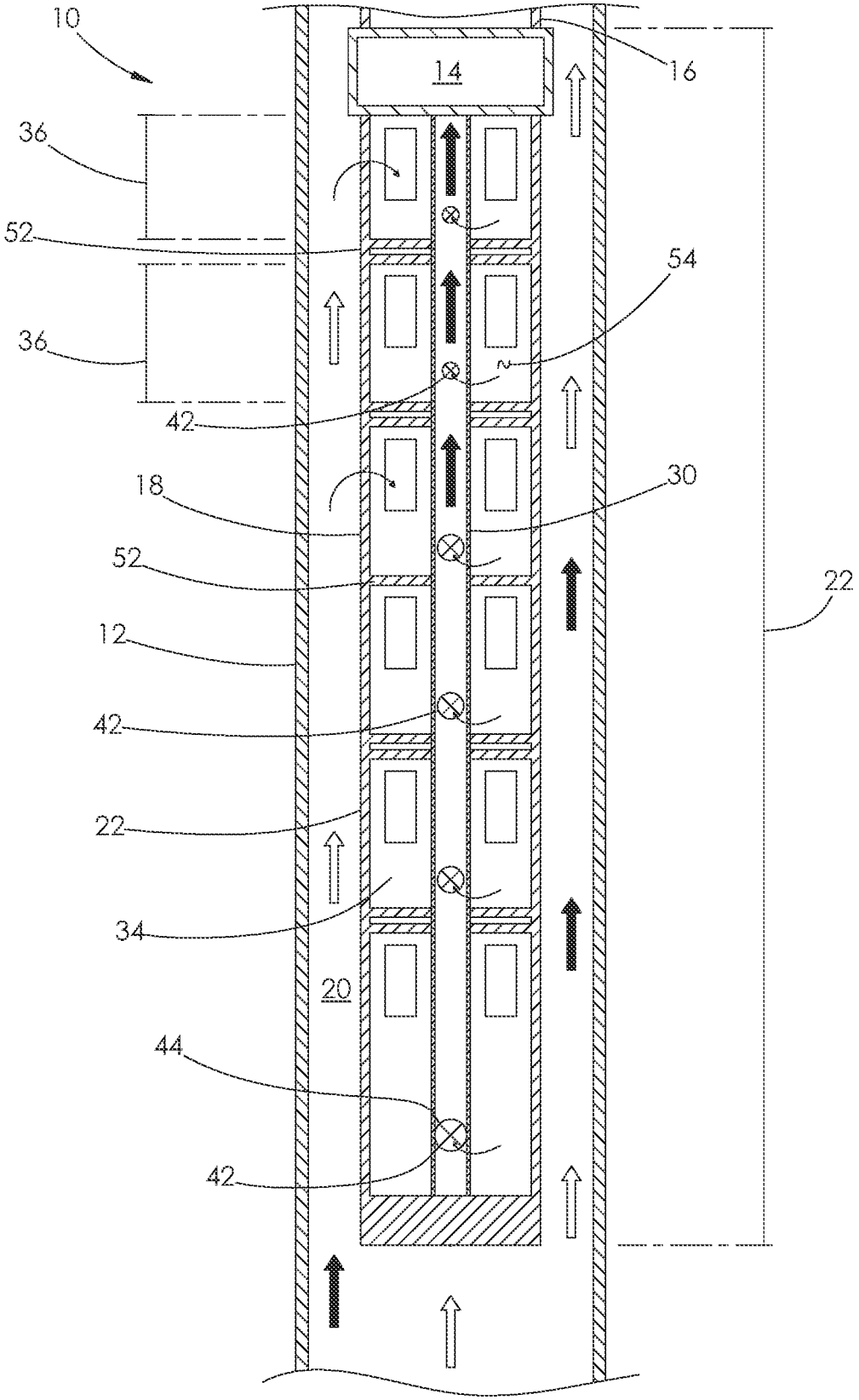
FIG. 4 is a schematic representation of a gas separator assembly comprised of a series of stacked, individual separation stages having no diverter separator attached at its bottom.

With reference now to FIG. 4, a fourth embodiment will now be described in further detail. In this instance, the assembly 10 comprises a multistage separator section 22, substantially identical in configuration to the multistage separator section 22 of FIG. 3, but with more individual separator stages 36 included therein. In this instance, each separator stage 36 again comprises a chamber 54 within the inner annular passage 34 between the outer tube 18 and the inner tube 30 and which is isolated at longitudinally opposing ends by respective isolation members 52. Each chamber 54 receives fluid through an intake slot 56 and the outer tube 18 and allows fluid to be drawn from the chamber into the inner tube 30 through the one or more limited entry ports 42 associated with that stage in the same manner as the previous embodiment.

The assembly 10 of FIG. 4 differs from the previous embodiment in that the multistage separator section 22 in this instance is used separately from any diversion separator section 40 so that no isolation plug 28 or intake section 24 is required. Instead, the outer annular region 20 between the casing 12 and the outer tube 18 receives fluid from the wellbore therebelow by being in open communication at the bottom end thereof to the wellbore therebelow. The bottom end of the outer tube 12 is enclosed by a lowermost one of the isolation members 52. In the illustrated embodiment, the bottom end of the inner tube 30 is also enclosed at the bottom end thereof so that fluid only enters the inner tube through the limited entry ports within the various stages 36 of the multistage separator 22.

In a variation of the embodiment of FIG. 4, the bottom end of the inner tube 30 may communicate with the wellbore therebelow through a bottom entry port 44 at the bottom end thereof, in which a variable valve 46 (such as that of FIG. 3) is provided within the bottom entry port 44 to regulate flow therethrough. Similarly to the description of the variable valve 46 in the previous embodiments, the valve is normally closed such that all fluid must be drawn through the limited entry ports across the various stages 36; however, as the limited entry ports become plugged, the variable valve 46 may open responsive to the variation in pressure to allow some flow to be diverted through the bottom entry port.

As a further alternative, the inner tube 30 may be open at its bottom such that the bottom stage does not have a limited-entry port.

It should be appreciated that in FIGS. 1-4, the solid arrows represent liquid flow, while the outlined arrows represent gas flow. In every embodiment of the invention, the goal is to allow gas to flow up the annulus of the wellbore while liquid settles into the separator and is removed using the inner tube 30, which is in communication with a pump.

Figure 5:
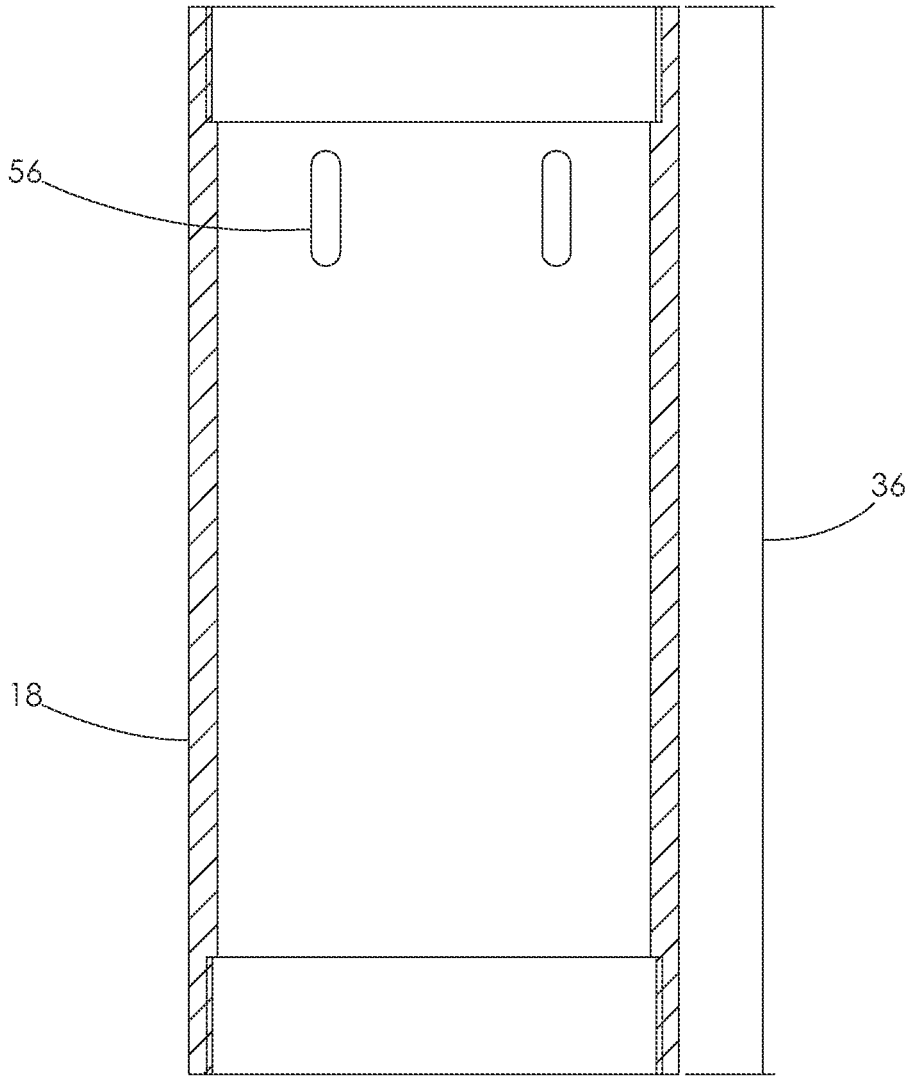
FIG. 5 is a sectional side view of one section of the gas separator assembly of FIGS. 3 and 4.

With reference to FIG. 5, the outer tube 18 of a single separator stage 36 is shown. The outer tube 18, as shown in preceding figures, has intake slots 56 disposed for fluid flow between each separation stage 36 and the outer annular region 20. As shown in FIG. 5, these openings are small relative to the length of the separation stage 36. For example, the intake slots 56 may be approximately one-sixth the length of the stage.

Such openings are satisfactory for separation operations. That is, they may properly allow wellbore fluid to transit into the "quiet-space" of the separator stage 36 and allow gas, once separated, to transit out of the stage and back into the annular region 20. That said, the placement of any apparatus, such as the multistage separator 22 (FIGS. 1-4), within the casing 12, restricts the cross-sectional area of the annular region 20. As a result, while flowrate remains approximately constant, velocity will increase. Such increased velocity increases the risk that liquid will flow past all of the intake slots 56 of the separator and remain in the annulus, reducing the effectiveness of the separation.

Figure 6:
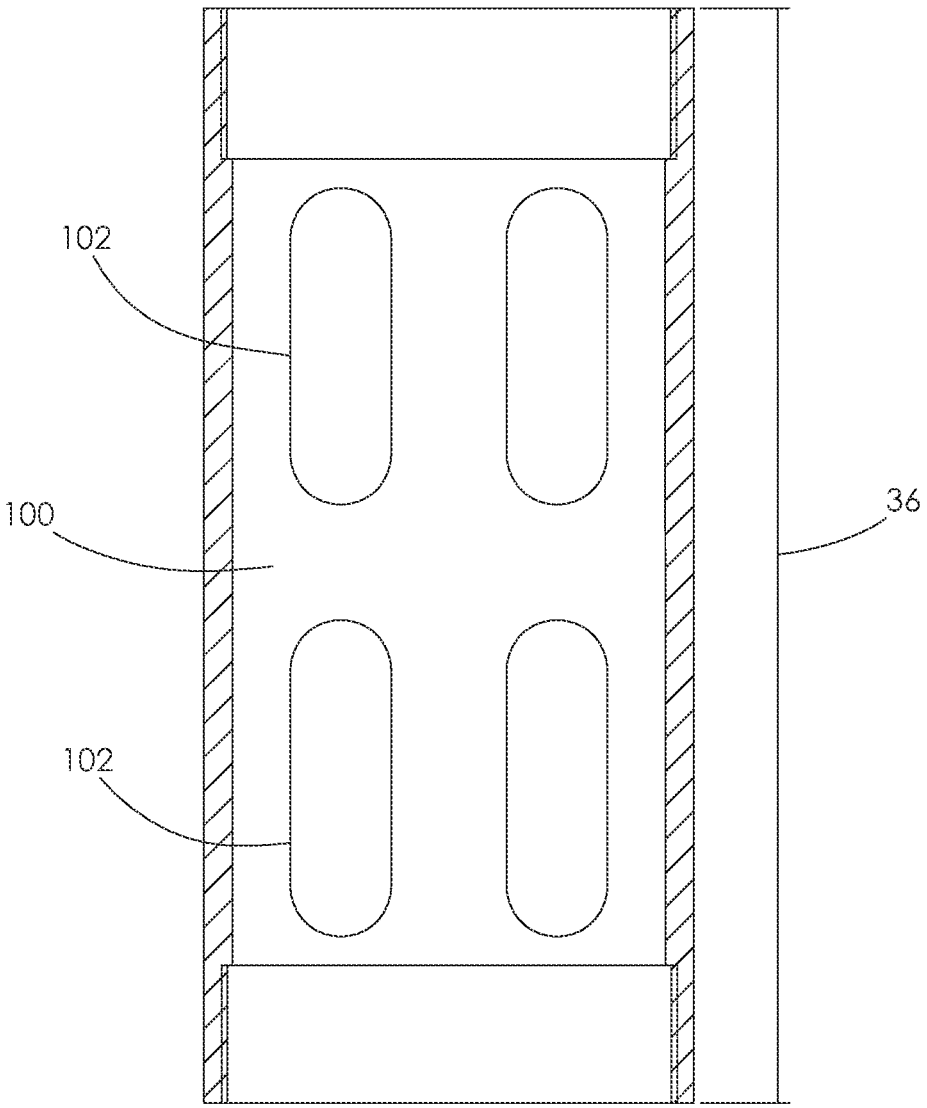
FIG. 6 is a sectional side view of one section of a gas separator assembly utilizing a modified outer tube for annular velocity disruption.
Figure 7:
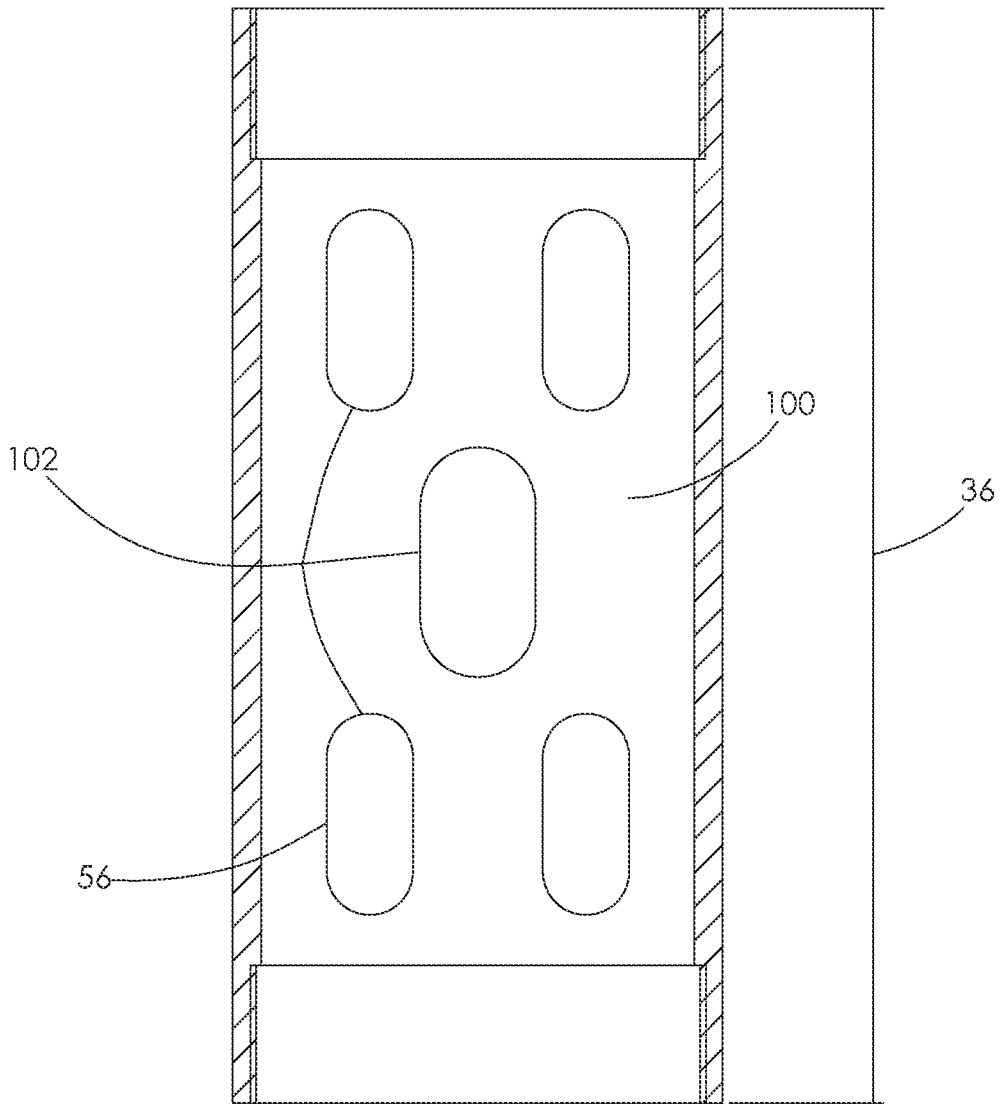
FIG. 7 is a sectional side view of one section of a gas separator, as in FIG. 6, but with a greater number of openings for annular velocity disruption.

With reference now to FIGS. 6 and 7, the outer tube 18 comprises an annular velocity disruptor ("AVD") apparatus 100. The AVD apparatus 100 comprises multiple large intake openings 102. In FIG. 6, there are four such openings 102 shown. In FIG. 7, there are five such openings 102 shown, though each set of openings 102 are phased at ninety degrees, such that three rows of four openings 102 are distributed about the perimeter of the apparatus 100. It should be understood that these openings extend about the perimeter of the apparatus 100 and are roughly evenly distributed (including on the back of the AVD apparatus 100 shown). It may be advantageous, where structural integrity allows, to stagger the distribution of the openings 102, as shown in FIG. 7. When thick materials are used, all the openings 102 may be cut along the same axis.

By increasing the size of the openings 102, a significant portion of the height of each stage 36 will include an opening to the "quiet-space" of each stage 36. For example, it may be preferable to include a minimum of sixteen to twenty inches of axial opening and as much as thirty inches of axial opening on each stage 36 to create annular velocity disruption. This effectively increases the cross-sectional area of the annular region 20 by allowing for very easy transmission of wellbore fluids across an outer wall 104 of the AVD apparatus 100. The length of the opening 102 may be dictated by modeled downhole well velocities, fluid properties (such as the foaminess of the material) etc. This is in contrast to common separators which have very narrow slots that are between an eighth of an inch and four inches wide, and only six inches tall. Such small slots are only thought to serve as a point of intake to the inside of a separator body.

Optimal dimensions are dependent upon the length of each stage 36. For example, for a 48" stage, the openings 102 may be 8"-16", more or less, with a 2"-3" width. For a 24" stage, the openings 102 may be 8"-12" in length, with a 2"-3" width. Dimensions are provided as examples only and are not restrictive, and wider openings 102 are certainly possible. It is advantageous for the openings 102 to be wide enough and long enough, relative to the stage 36 length, to meaningfully disrupt or stall the flow of material in the annular space 20. It may be advantageous for each opening 102 to have a width no less than one tenth of its height.

The AVD apparatus 100 may be used on one or more of the stages 36 of the multistage separation apparatus 22. By increasing the cross-sectional area of the annular section 20, fluid flow is slowed or completely stalled, creating an area across the AVD apparatus 100 that is liquid loaded with a higher concentration of fluid. This enhances separation at each stage and decreases the likelihood for liquid to flow by the entire separator 22.

Since various modifications can be made in my invention as herein above described, and many apparently widely different embodiments of same made, it is intended that all matter contained in the accompanying specification shall be interpreted as illustrative only and not in a limiting sense.

Changes may be made in the construction, operation and arrangement of the various parts, elements, steps and procedures described herein without departing from the spirit and scope of the invention as described in the following claims.

The invention claimed is:

1. A separator comprising:

a first, innermost tube configured for communication with a pump;

a second, outermost tube, surrounding the first tube; and a third tube, disposed between the first tube and the second tube, such that a first annular region is formed between the first and third tube and a second annular region is formed between the second tube and the third tube;

in which the third tube comprises a plurality of separator stages, each of the separator stages comprising:

a first isolation member and a second isolation member, each isolation member forming a boundary of the separator stage within the first annular region;

a limited entry port interconnecting the each of the separator stages and the first tube; and an opening interconnecting the each of the separator stages and the second annular region in which the limited entry port in a first selected one of the plurality of separator stages is smaller than the limited entry port in a second selected one of the plurality of separator stages, wherein the second selected one of the plurality of separator stages is directly below the first selected one of the plurality of separator stages.

2. A system comprising:

a pump; and the separator of claim 1;

wherein the separator is disposed downhole in a wellbore.

3. A method of using the system of claim 2 comprising:

receiving a multi-phase substance into the first annular region of each separator stage at each of the openings;

at each of separator stages, separating the multi-phase substance into a liquid portion and a gaseous portion; and with the pump, removing the liquid portion from each of the separator stages.

4. The separator of claim 1 in which one of the plurality of separator stages comprises a velocity disruption stage, wherein a length of the at least one opening of the velocity disruption stage is greater than a length of an adjacent separator stage.

5. The separator of claim 1 in which the first tube is characterized by a first end, in which the first end is disposed below each of the limited entry ports and defines a bottom entry port.

6. The separator of claim 5 further comprising a pressure responsive variable valve disposed at the bottom entry port.

7. The separator of claim 6 in which the variable valve is configured to adjust a cross-sectional flow area in response to a pressure differential across the variable valve.

8. The separator of claim 1 in which one of the plurality of limited entry ports has a diameter of one sixteenth of an inch.

9. The separator of claim 1 in which the opening is configured to disrupt the flow of material within the second annular region.

10. The separator of claim 1 in which the opening is characterized as a first opening, and further comprising a second opening interconnecting the at least one of the separator stages and the second annular region.

11. The separator of claim 1 in which the opening has an axial length of at least eight inches and a width of at least two inches.

12. The separator of claim 1 in which the second tube is a well casing.

13. The separator of claim 1 in which the third tube is connected to a tubing string.

14. A method comprising:

placing the separator of claim 1 within a wellbore;

directing multi-phase hydrocarbon material within the wellbore to the second annular region;

disrupting a velocity of the multi-phase hydrocarbon material at the openings and the plurality of separator stages, whereby the multi-phase hydrocarbon material enters the first annular region;

intaking a liquid-rich portion of the multi-phase hydrocarbon material at the limited entry port in each of the plurality of separator stages; and directing a gas-rich portion of the multi-phase hydrocarbon material back to the second annular region.

15. The separator of claim 1, in which the limited entry port in each of the plurality of separator stages is arranged from bottom to top in order of decreasing size.

* * * * *